US006415459B1

(12) United States Patent
Sevier

(10) Patent No.: US 6,415,459 B1
(45) Date of Patent: Jul. 9, 2002

(54) TUB FOR PHYSICALLY HANDICAPPED PERSONS

(76) Inventor: Robert E. Sevier, 44 Sturbridge La., Greensboro, NC (US) 27408

( * ) Notice: Subject to any disclaimer, the term of this patent is extended or adjusted under 35 U.S.C. 154(b) by 0 days.

(21) Appl. No.: 09/841,410

(22) Filed: Apr. 24, 2001

(51) Int. Cl.[7] ..... A47K 3/02
(52) U.S. Cl. ..... 4/566.1; 4/564.1
(58) Field of Search ..... 4/564.1, 565.1, 4/566.1

(56) References Cited

U.S. PATENT DOCUMENTS

| | | | | | |
|---|---|---|---|---|---|
| 1,683,430 | A | * | 9/1928 | Wright | 4/566.1 X |
| 3,106,723 | A | * | 10/1963 | Carpenter | 4/564.1 |
| 3,400,410 | A | | 9/1968 | Sallinger | 4/185 |
| 3,435,466 | A | | 4/1969 | Cheney | 4/185 |
| 3,561,018 | A | | 2/1971 | McVay | 4/185 |
| 3,581,316 | A | | 6/1971 | Petersen | 4/185 |
| 3,758,894 | A | | 9/1973 | Finley | 4/185 R |
| 3,958,282 | A | | 5/1976 | Crowe | 4/185 L |
| 4,013,316 | A | | 3/1977 | Cropper | 297/347 |
| 4,034,426 | A | | 7/1977 | Hardwick et al. | 4/185 L |
| 4,091,479 | A | | 5/1978 | Hancock | 4/185 S |
| 4,128,904 | A | | 12/1978 | Ekman et al. | 4/185 L |
| 4,211,216 | A | | 7/1980 | Burgess et al. | 128/66 |
| 4,253,203 | A | | 3/1981 | Thomas | 4/559 |
| 4,574,408 | A | | 3/1986 | Dentler et al. | 4/560 |
| 4,624,019 | A | | 11/1986 | Pennington-Richards | 4/566 |
| 4,932,087 | A | | 6/1990 | Schmidt | 4/560 |
| 5,007,121 | A | | 4/1991 | McEathron | 4/566 |
| 5,157,797 | A | | 10/1992 | Forwick | 4/566.1 |
| 5,167,042 | A | * | 12/1992 | Holmes | 4/564.1 |
| 5,263,207 | A | | 11/1993 | Gilbert | 4/562.1 |
| 5,402,541 | A | | 4/1995 | Schmidt | 4/566.1 |
| 5,423,096 | A | | 6/1995 | Janisch | 4/566.1 |
| 5,606,751 | A | | 3/1997 | Baker | 4/560.1 |
| 5,797,149 | A | | 8/1998 | Mustarde | 4/566.1 |
| 5,806,110 | A | | 9/1998 | Kunz et al. | 4/566.1 |
| 5,822,809 | A | | 10/1998 | Gallo | 4/578.1 |
| 5,839,131 | A | | 11/1998 | Schaffer | 4/560.1 |
| 5,855,028 | A | | 1/1999 | Colbert | 4/566.1 |

OTHER PUBLICATIONS

Citadel 500, Five–Section High/Low Table, Citadel* Electric High/Low Treatment Tables from Smith & Nephew, date unknown.

Photographs of High/Low Table, date unknown.

* cited by examiner

*Primary Examiner*—Charles E. Phillips
(74) *Attorney, Agent, or Firm*—Womble Carlyle Sandridge & Rice, PLLC

(57) ABSTRACT

A tub for use by handicapped persons for bathing or therapeutic purposes having a tub enclosure, an opening formed in the floor of tub enclosure for receiving a seating member, a seating member that is sized to engage the tub enclosure around the opening in the floor, and a lifting mechanism for lowering and raising the seating member, whereby the lifting mechanism enables handicapped persons to position themselves on the seating member and then lower and raise themselves into and out of the tub.

28 Claims, 6 Drawing Sheets

TUB FOR PHYSICALLY HANDICAPPED PERSONS

FIELD OF THE INVENTION

The present invention relates to devices for assisting physically handicapped or otherwise incapacitated persons, and, more particularly, to tubs for bathing or therapeutic purposes.

BACKGROUND OF THE INVENTION

Tub bathing for the elderly or other persons suffering from physical disabilities presents substantial difficulties since such persons often lack the capacity to get safely into or out of a conventional tub. Due to the standard design of tubs wherein one must lower oneself into a sitting posture in a tub enclosure and then raise oneself above the rim of the tub to get out, numerous accidents involving infirm or disabled individuals occur each year with serious consequences. As a result, such persons often require human assistance in performing what, for persons without such infirmities, is a simple task. Even with assistance, there is often accompanying humiliation, feeling of inadequacy, loss of independence, and a significant loss of privacy over personal matters.

Over the years, a variety of devices have been conceived and developed for assisting physically handicapped persons in performing various functions. A number of these devices have been directed to the bathing function and for adaptation with conventional tubs. There are known in the art power lift bathtub seats, elevatable and suspendable chairs, and inflatable cushions, to mention a few. However, many of these devices must be specially retrofitted into a conventional tub, leaving the tub usable only by the handicapped person, while others are extrinsic to the tub and must be moved into and out of place with each use. They are generally unsightly and often cumbersome. Many are unsafe in their own right. Further, these devices limit the degree of movement that the individual has once in the tub, and most still require some degree of physical exertion in lowering or raising oneself. For persons incapable of this level of physical exertion, these devices offer no solution.

SUMMARY OF THE INVENTION

The present invention is directed to a tub for use by handicapped or otherwise incapacitated persons for bathing or therapeutic purposes and overcomes the problems described above. That is, the tub of the present invention requires minimal physical exertion by the user and yet does not require special attachments or inserts. Rather, in all respects, the tub appears to be a conventional tub and may be used by persons other than a particular handicapped individual. The tub includes a tub enclosure with a floor opening, a movable seating surface for engaging the floor opening, a means to seal the interface between the floor and the movable seating surface, and a lifting mechanism for raising and lowering the seating surface.

The tub enclosure will typically be shaped as a conventional bathtub with a generally rectangular shape; however, the enclosure is not limited to any particular geometry. Rather, the tub enclosure may resemble and be used in conjunction with an oval-shaped whirlpool tub or take on a larger shape such as a hot tub or even a therapeutic tub enclosure. The tub enclosure of the present invention need have only a floor portion that is substantially flat to receive the movable seating surface. When installed, the visible portion of the tub will be dimensioned similar to conventional tubs with respect to the surface of the room floor on which it is installed. An opening is formed through the floor of the tub that is sized to receive a generally flat seating surface. The size of the opening and the corresponding seating surface are not critical so long as the seating surface is sufficiently sized to accommodate an adult in a sitting posture.

Because the seating surface is movable, seals are provided around the contact interface between the floor of the enclosure and the seating surface to prevent leakage of water through the floor of the tub enclosure when the tub is filled with water. The seals are formed of a rubber or other suitable elastomeric material and may be affixed to either the bottom peripheral edges of the seating surface or upper peripheral edges of the floor opening, or both, in any of a number of ways conventionally known in the art for sealing such closures.

A lifting mechanism is operatively attached to the underside of the seating surface so that when the seating surface is engaged with the floor of the enclosure, the lifting mechanism is concealed and disposed beneath the seating surface of the tub. This, of necessity, requires a mechanical operating area, or chamber, beneath the tub floor. The dimensions of this chamber will, of course, depend upon the type of lifting mechanism employed.

In operation, when the user activates the lifting mechanism, the movable seating surface disengages and is raised to a height essentially level with the rim of the tub enclosure. This allows the user to easily position himself or herself on the rim of the tub and then to pivot and transfer onto the seating surface without undue exertion. Once on the seating surface, the user again activates the lifting mechanism to lower the seating surface for sealing engagement with the floor of the tub. The user may then proceed to fill the tub and bathe in a normal fashion. Once bathing is complete, the water is allowed to drain from the tub. When the tub is empty, the user again activates the lifting mechanism to raise the seating surface to the elevated position from whence the user more easily disembarks.

Various lifting mechanisms may be suitably used to raise and lower the seating surface of the present invention, some of which are described in detail hereinbelow. In one approach, a pneumatic or hydraulic cylinder is attached at one end to a floor surface or frame and the piston at its opposite end is connected to a lever system. When operated, the piston causes the lever system to raise the movable seating surface from a first position in sealed engagement with the floor of the tub to a second elevated position essentially level with the top of the tub. In another approach, a hydraulic lift cylinder is connected to the seating surface. Auger or gear-driven systems may also be used in place of hydraulic or pneumatic cylinders.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
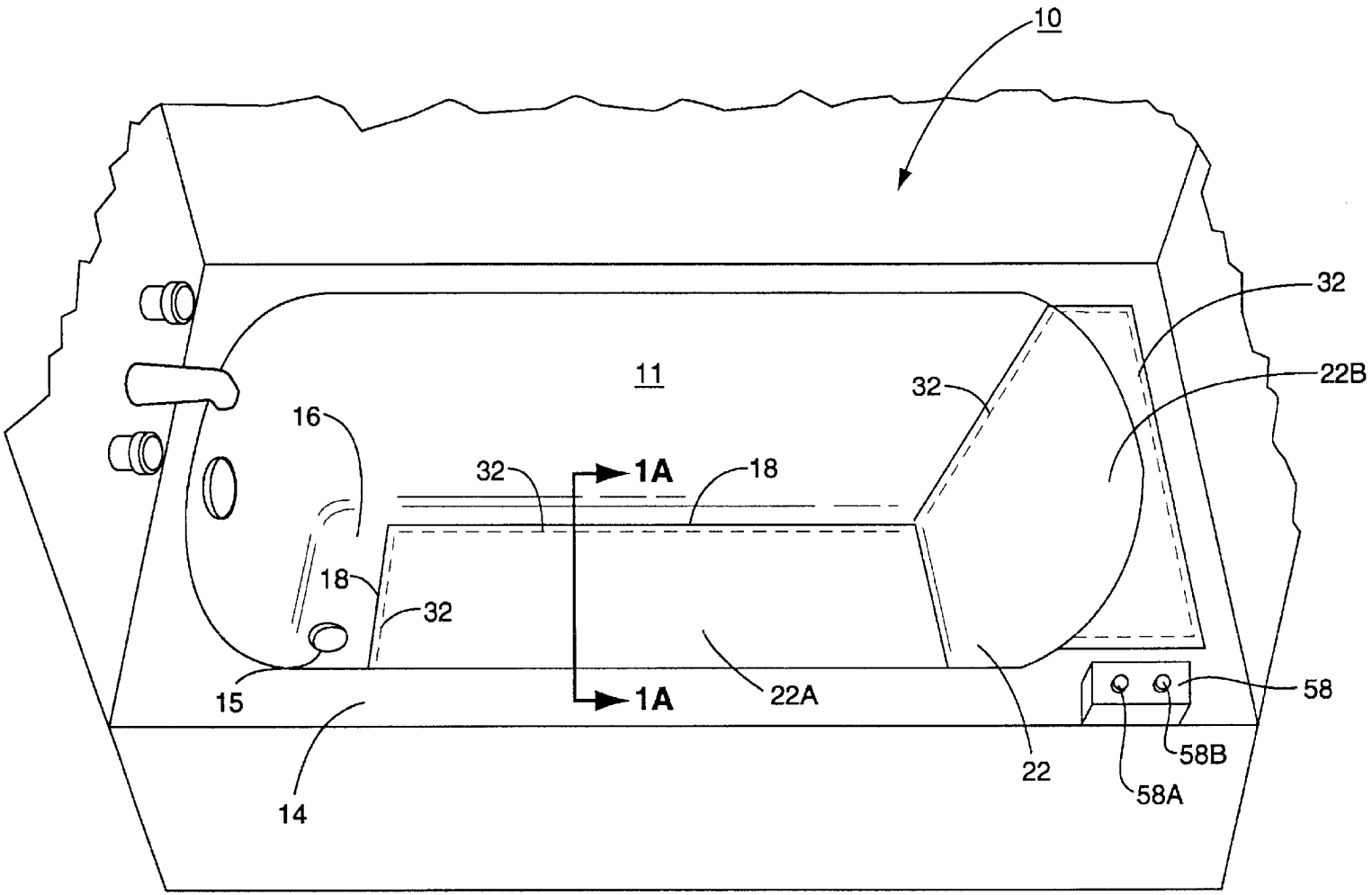
FIG. 1 is a front perspective view of the tub of the present invention.

As shown in FIG. 1, the present invention is directed to a tub for use by handicapped or otherwise incapacitated persons. Shown generally as 10, the tub includes a tub housing 14 having side walls 11 and floor 16, and a movable seating member or surface 22 in the floor 16. A lifting mechanism (shown generally as 40 in FIG. 2) provides for the lifting of the seating member 22 from a first position in the floor 16 of the tub to an elevated second position. In the first position, seals 32 prevent water leakage through the floor 16.

Figure 2:
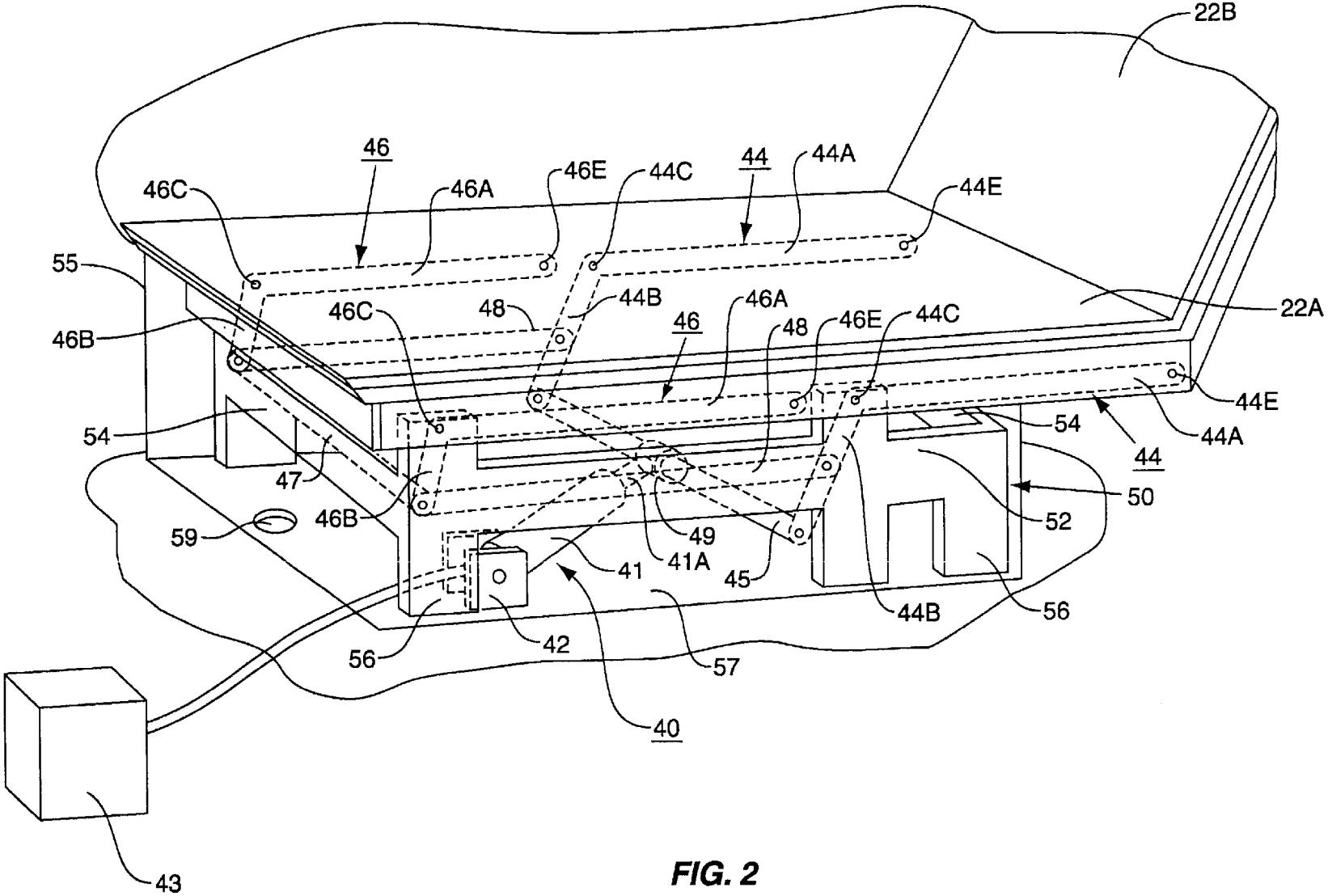
FIG. 2 is a front perspective view of the tub of FIG. 1 with the outer tub walls broken away and illustrating the underlying structure of the tub and lifting mechanism with the seating member of the tub lowered.
Figure 3:
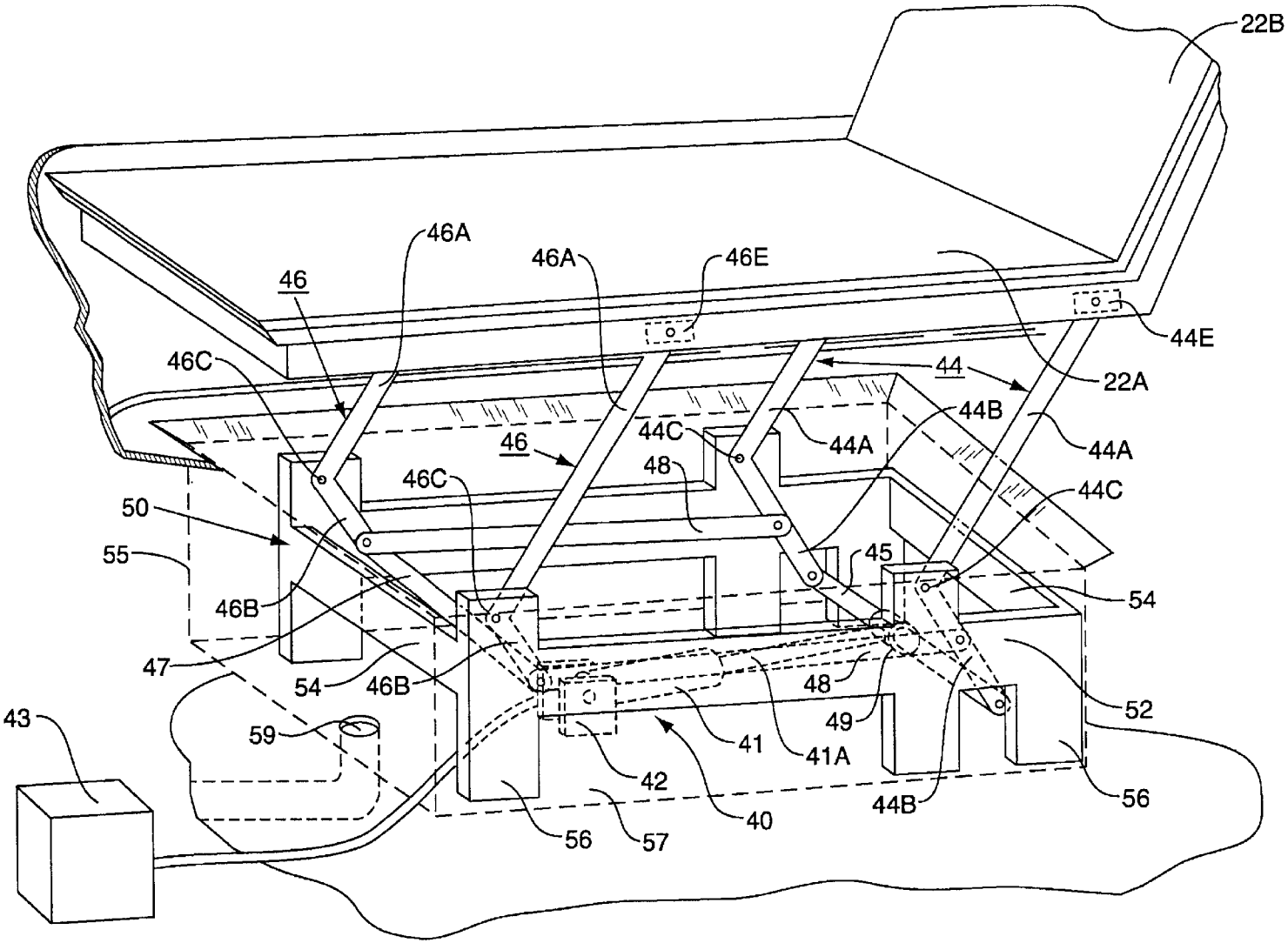
FIG. 3 is a front perspective view similar to FIG. 2, illustrating the underlying structure of the tub with the seating member of the tub raised.

FIGS. 1 through 3 are illustrative of the preferred embodiment of tub 10. The tub housing 14 resembles a conventional bathtub, but the sizes and relative shapes of tub 10 are not limited thereto. The tub 10 is alternatively shaped as a whirlpool tub, Jacuzzi, hot tub, or therapeutic tub. Tub housing 14 is intended to hold a sufficient volume of water for bathing or therapy and has a generally flat floor portion 16. However, the floor portion 16 may alternatively be textured, curved, inclined, or otherwise formed so long as a seating member may properly engage therewith. The tub housing 14 is constructed of conventional tub polymeric material, but other suitable materials, including metals, ceramics, and fiberglas may alternatively be used. As best seen in FIGS. 1 and 3, a generally rectangular opening 18 is formed through the floor 16 of tub enclosure 14 for receiving the movable seating member 22. A conventional drain opening 15 is formed at the forward end of tub enclosure 14 for draining used water in a conventional manner through attached plumbing drain lines (not shown).

Figure 1A:
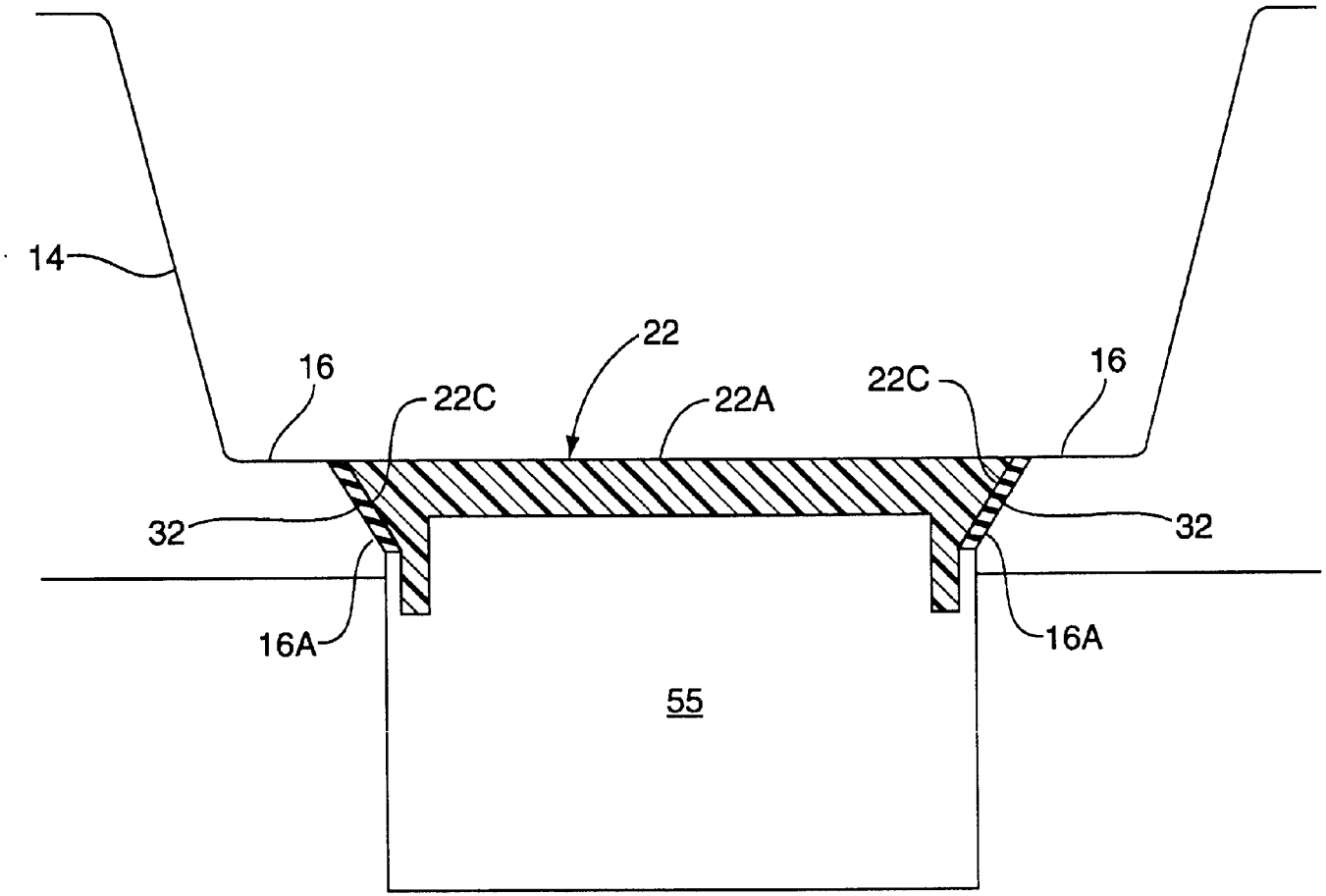
FIG. 1A is a sectional view taken along Line 1A—1A illustrating the placement of seals between the floor of the tub and the seating member.

The tub shown in FIGS. 1 through 3 has an inside length of approximately 67 inches at the top rim and 57 inches at the floor 16. Tub housing 14 is also approximately 24 inches wide and 15 inches deep. The size and shape of opening 18 formed through the floor 16 of tub enclosure 14 corresponds to the size and shape of the movable seating member 22. Seating member 22 preferably has a substantially flat upper surface 22A and an integrally formed back support 22B; however, it could also be in other configurations such as flat and backless. Seating member 22 is desirably approximately 45 inches long and 23 inches wide. As best seen in FIG. 1A, and as representative of the front, rear, and side surfaces 22C of seating member 22, side surfaces 22C of seating member 22 are beveled at approximately 45 degrees from the horizontal. Likewise, the peripheral edges 16A of the opening 18 formed in the floor 16 of tub enclosure 14 are beveled a corresponding 45 degrees. When seating member 22 is in its lowered position, it engages the opening 18. Seals 32 around the inner periphery of opening 18 prevent water leakage through the bottom of the tub 10 when the tub is filled with water. FIG. 1A illustrates the placement of seals 32 between the tub floor 16 and the side surfaces 22C of seating member 22. Seals 32 are formed of rubber or other suitable elastometric material and are attached around the periphery of opening 18 using any of the conventional adhesives that are known in the art for compatibility with the seal 32 material as well as the material of the tub enclosure 14. Further, seals 32 may be alternatively positioned around and attached to the beveled surfaces 22C of movable seating member 22, or they may be attached to both peripheral surfaces 16A of the tub floor 16 and the underside periphery 22C of movable seating member 22.

When movable seating member 22 is in a lowered position and is engaging tub enclosure 14 at opening 18, a substantial portion of tub 10 will rest on a supporting frame structure, shown generally as 50 in FIGS. 2 and 3. Frame 50, in turn, also serves as a support structure for the lever system of lifting mechanism 40. Because the frame 50 and lifting mechanism 40 are concealed and disposed beneath tub 10 and seating member 22, a mechanical operating chamber 55 is provided beneath tub 10. The chamber 55 is sized to provide sufficient space for placement of frame 50 and lifting mechanism 40. In the preferred embodiment, chamber 55 need only have a rigid bottom member or surface 57 for the mounting of lifting mechanism 40. The chamber 55 shown in FIGS. 2 and 3 is approximately 12 inches high, 18 inches wide, and 38 inches long. It will be appreciated by those skilled in the art that for certain installations, such as those where a rigid bottom member or surface 57 is not already available, for example, in the subflooring of a house, the chamber may be constructed with side and end members connected with a rigid bottom member. Alternatively, as described hereinbelow with reference to FIG. 4, a rigid bottom member may not be required when the cylinder 61 of the lifting mechanism 60 is mounted to frame 50'. In such case, the chamber is separately constructed beneath the floor of the room in which the tub 10 is to be installed prior to installation of the tub. Where chamber 55 is enclosed, a supplemental drain 59 is provided to carry away any water or moisture which might migrate or leak into chamber 55 due to leakage of seals, inadvertent operation of the movable seating member 22, etc. Conventional drain line connections (not shown) would be made between existing waste lines and drain 59.

Frame 50 is constructed as a generally rectangular structure having side members 52, end members 54, and legs 56. Frame 50 may be integrally formed or constructed of individual members and legs that are fastened together in any of the conventionally known means for fastening, including bolting, welding, etc. Frame 50 provides a support platform for the lever system of lifting mechanism 40 as described hereinbelow.

As shown in FIGS. 2 and 3, the lifting mechanism 40 is operatively attached to the underside of movable seating member 22 and to frame 50. In the preferred embodiment, lifting mechanism 40 includes a pneumatic or hydraulic cylinder 41 that drives a lever system 44,45,46,47,48 to lift and lower seating member 22. As illustrated in FIGS. 2 and 3, one embodiment of the lever system includes a first pair of levers 44 at one end of seating member 22 and another pair of levers 46 at the other end of seating member 22. Each lever 44 includes a long arm 44A and a short arm 44B forming an angle at a fulcrum point 44C. The two arms are angled with respect to one another at an obtuse angle for purposes of providing a sufficient lift height for movable seat 22 when seat 22 is raised. It has been found that having levers 44 each formed of a long horizontal portion 44A about 21 inches long and a short angled portion about 11½ inches long in the case of lever 44 or about 6½ inches long in the case of lever 46, wherein the angle between the two is approximately 108 degrees, provides for the shortest stroke of piston 41A to achieve the longest lift of movable seat 22. The free end of each long arm 44A and 46A are pivotally attached to a side wall of seating member 22 at latch 44E and 46E, respectively, using conventional pin fasteners. The levers 44 are pivotally attached to the supporting frame 50 at 44C. The free end of each short arm 44B is connected together by an operating rod 45. Levers 44 are formed of tube or bar stock and are substantially parallel to one another and to the sides of movable seating member 22.

The other pair of levers 46 is similarly attached to the other end of seating member 22 and the frame 50. Connecting rods 48 connect the levers 44, 46 on each side, so that they operate together. Cylinder 41 is pivotally mounted to a rigid member or surface 57 underneath tub 10 with a channel bracket or lug 42 that is rigidly affixed to member or surface 57. A pump-operated hydraulic or pneumatic expansion chamber 43 is connected to cylinder 41 to provide a fluid pressure and letdown source. Channel bracket or lug 42 is fastened to a rigid member or surface 57 using any of the conventionally known means for anchoring such a structural element. The piston 41A of cylinder 41 is operatively connected to the operating rod 45 with a collar or journal 49. The lifting mechanism is designed with cylinder 41 of such specifications that the lever system has a lifting capacity of 300 pounds.

As best seen in FIG. 3, when piston 41A extends upwardly due to the application of fluid pressure from expansion and compression chamber 43, rod 45 causes levers 44 to pivot upward about fulcrum axis 44C. The rearward and upward movement of the short portions of levers 44 causes tracking bars 48 to move rearward. The rearward movement of connecting bars 48 causes connected levers 46 to pivot upward about fulcrum points 46C. The synchronous pivotal movement of levers 44 and 46 causes connected movable seat 22 to rise in a substantially level fashion through a vertical column a distance of approximately 14 inches and to shift laterally toward the forward end of the tub a distance of approximately 5 inches. When completely raised, the upper surface of seating member 22 is substantially at the same level as the top edges of tub enclosure 14. To facilitate access to chamber 55 and lifting mechanism 40, seating member 22 is releasably connected to levers 44, 46 by latches 44E and 46E. Latches 44E and 46E may be locking pins, slides, or other suitable hardware for releasably pivotally connecting levers 44, 46 to seating member 22.

A control pad 58 is provided that is conveniently accessible to the user. As shown in FIG. 1, the control pad is mounted on one side of tub 10; however, the location of panel 58 is not restricted to any particular location so long as it is within the reach of the expected user. Desirably, control pad 58 has two buttons or switches, 58A and 58B that are used to selectively activate the lifting mechanism 40 to raise or lower the movable seat 22. Control pad 58, with the "raise" and "lower" buttons 58A and 58B, is chosen to conform to the power and connection requirements for the particular lifting mechanism employed. The provision of switches or buttons in a panel configuration is well known and within the knowledge and skill of those in the art, and may be installed in any number of suitable ways.

In operating the tub 10 of the present invention, the user first raises the seating surface 22 of a drained tub 10 by manipulating the raise button (switch 58A). Once the seat is raised to the level of the edges of tub 10, the user will sit on and across tub housing 14 and onto the seating surface 22, pivoting his or her body around completely onto and in substantial alignment with the seating surface 22. That is, the user's body will be substantially evenly supported across the seating surface 22 and the user will be facing toward the forward end of the tub 10 in a conventional manner. Once in place, the user lowers the seating surface 22 by manipulating the lower button (switch 58B). When lowered, seating surface 22 moves into sealed engagement with opening 18. The user then fills the tub 10 to the desired level in a conventional fashion. When finished bathing, the user first drains the tub 10 and then manipulates switch 58A to raise the seating surface 22 to a height substantially level with the top edge of tub enclosure 14, whereupon where the user dismounts the seating surface 22.

Figure 4:
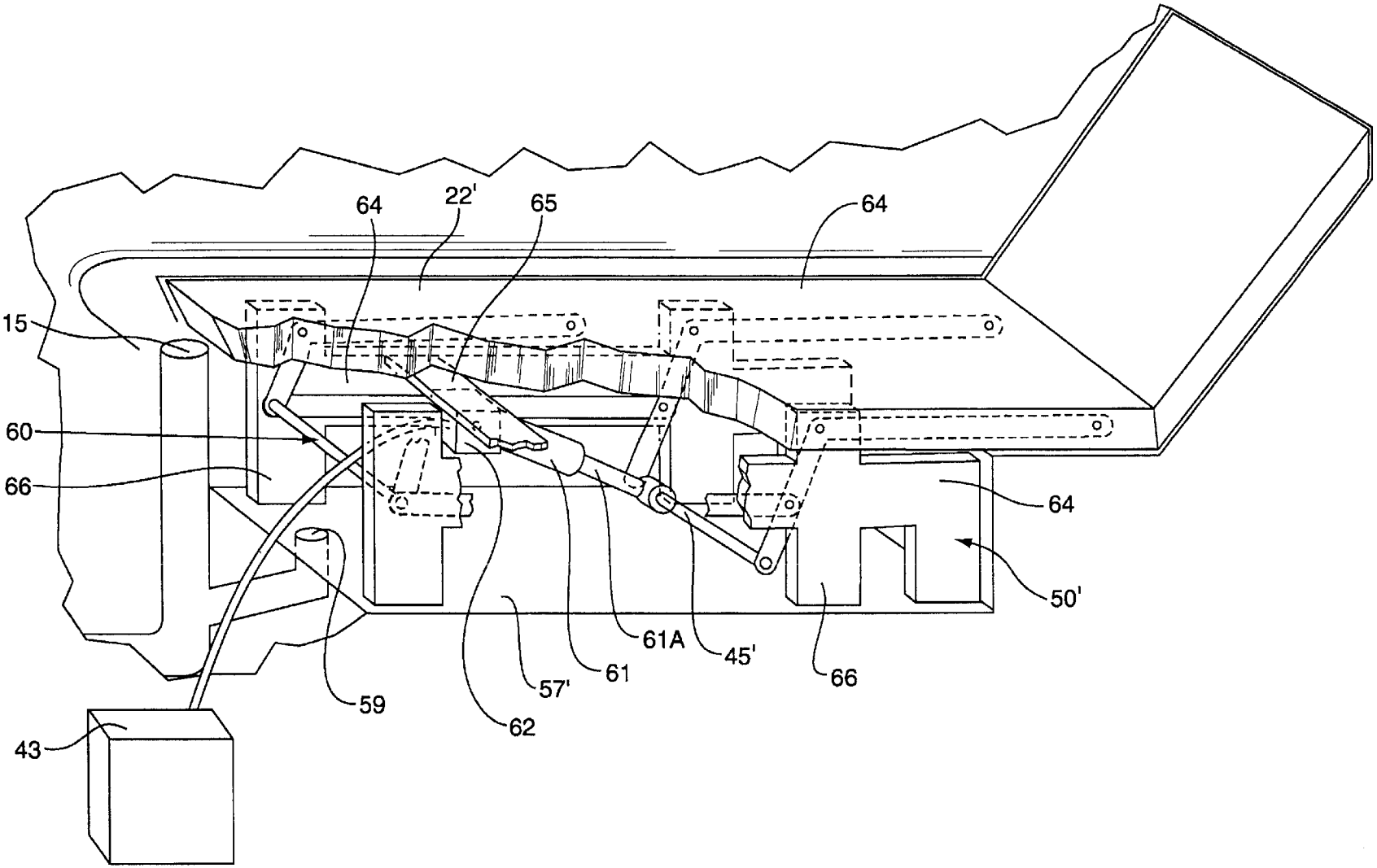
FIG. 4 is a front perspective view of the tub of the present invention illustrating an alternative installation for the lifting mechanism.

As an alternative to the configuration of the lifting mechanism 40 described hereinabove, the piston may be mounted above the surface of the Chamber 57' floor to the frame 50'. This configuration provides a greater mechanical advantage at the beginning of the lift while requiring approximately one-third less chamber depth beneath the movable seating member for installation. As seen in FIG. 4, the lifting mechanism is shown generally as 60. Cylinder 61 is pivotally mounted to frame 50' and extends rearwardly and slightly downwardly. Thus, when in operation, the piston 61A has a rearward and slightly downward movement. Mounted in this fashion, piston 61A has an initial mechanical advantage slightly greater than piston 41A in the embodiment described hereinabove. Further, there is no need to have a rigid member or surface 57' beneath cylinder 61 for mounting thereon. Rather, a bracing member 65 (FIG. 4) extending between opposed sides 64 provides the structural attachment point for a channel bracket or lug 62. Bracket or lug 62 may be welded to bracing member 65 or may be attached with any of the variety of mechanical fasteners. Cylinder 61 is pivotally connected at one end to bracket or lug 62, and piston 61A at the other end to connecting rod 45' in the same manner as described hereinabove. In all other respects, the lifting mechanism 60 is the same as described hereinabove for the preferred embodiment.

Figure 5:
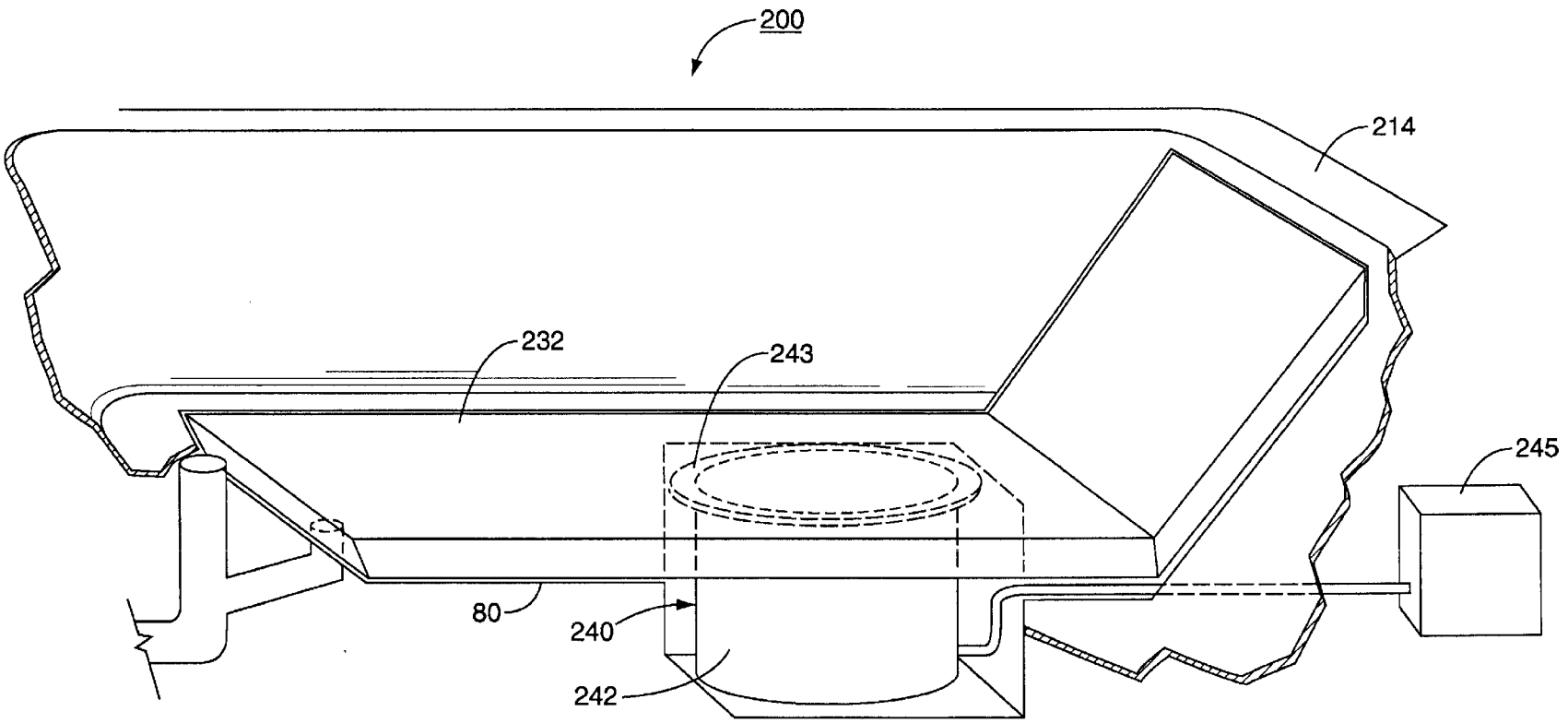
FIG. 5 is a front perspective of the tub of the present invention illustrating an alternative form of lifting mechanism.

A further embodiment of the present invention is shown in FIG. 5. Lifting mechanism 240 replaces the lifting mechanisms described hereinabove with a single hydraulic cylinder lift 242 mounted substantially below the surface 80 of the floor upon which tub 200 is to be installed. This embodiment, while requiring a subfloor installation, eliminates the need for any form of supporting frame. Lift 242 is capable of lifting at least 300 pounds. A hydraulic lift cylinder sufficient for this application is conventionally known by and available to those skilled in the art. Hydraulic lift 242 is connected to movable seat 232 by means of a plate or flange 243 that interconnects the bottom of the movable seat and the upper portion of the hydraulic lift. The hydraulic lift 242 is positioned beneath movable seat 232 and plate or flange 243 is attached to seat 232 so that lift 242 corresponds with the approximate expected center of mass of an individual sitting on movable seat 232. In all other respects, the shape of tub 200 with tub enclosure 214 and movable seating surface 232 are similar to tub 10, including the provision of seals for preventing leakage.

The present invention is not limited to the lifting mechanisms heretofore described. For example, other forms and shapes of levers may be constructed to satisfactorily raise and lower the movable seat of the present invention. Similarly, auger or gear-driven arrangements may be substituted for the hydraulic or pneumatic pistons as the motive element for engaging the lifting mechanism.

Although the present invention has been described with one or more preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A tub for use by handicapped or otherwise incapacitated persons for bathing or therapeutic purposes, comprising:

(a) a tub enclosure having a floor, said floor having an opening formed therethrough for receiving a seating member;

(b) a seating member having a front end and a rear end and opposed sides, said seating member so dimensioned to engage said tub enclosure around the opening in said floor portion and movable between a first position seated in the floor of the tub and an elevated position;

(c) the interface between the seating member and said opening being so sealed as to substantially prevent water leakage therethrough when said seating member is seated in the floor of the tub; and (d) a lifting mechanism operatively attached to the underside of said seating member, said lifting mechanism, when activated in one direction raises said seating member to said second position at a height sufficient to enable handicapped persons to position themselves thereon, and when further activated in the other direction lowers said seating member to said first position in sealing engagement with the floor of said tub.

2. The tub of claim 1 wherein said front and rear ends and opposed sides of said seating member have beveled edges for mating with corresponding beveled edges around the interface of said tub enclosure, said seating member and/or the portion of the tub floor surrounding said opening further including an elastomeric seal around said interface between said beveled edges of said seating member and said beveled edges of said tub enclosure for sealing engagement thereof.

3. The tub of claim 1 wherein said seating member has a generally horizontal floor portion.

4. The tub of claim 1 wherein said seating member comprises:

(a) a generally horizontal floor portion; and (b) a back portion, said back portion integrally attached to said floor portion.

5. The tub of claim 1 wherein said tub enclosure further includes at least one drain aperture formed therethrough.

6. The tub of claim 1, wherein when said seating surface is matingly engaged with the floor of said tub enclosure, said bathtub resembles a conventional tub.

7. The tub of claim 1 wherein said lifting mechanism comprises:

(a) a frame positioned beneath said seating member;

(b) a lever system connecting said frame and said seating member; and (c) a piston/cylinder actuator operatively connected to said lever system to move said seating member between said first and second position responsive thereto.

8. The tub of claim 1 wherein said lifting mechanism comprises:

(a) a frame extending beneath said seating member;

(b) first and second pairs of levers, each of said levers including a long arm extending in generally parallel to said seat member and having a free end and a short arm extending downwardly and at an angle to said seat member and having a free end, the other ends of said long and short arms being pivotally connected to each other and pivotally attached to said frame at a fulcrum point wherein said levers are pivotally attached to said frame:

(c) the free ends of each of said long arms of said first pair of levers being pivotally connected to opposed sides of the rear end of said seating member and the free ends of each of said long arms of said second pair of levers being pivotally connected to opposed sides of said seating member;

(d) wherein the free ends of said short arms of one of said first and second pair of levers are connected by an operating rod;

(e) at least one connecting rod extending between and connecting said first and second pairs of levers;

(f) a cylinder having a piston, said piston operatively connected to said operating rod, wherein when activated said piston causes the long arms of said first and second set of parallel levers to simultaneously pivot upward about said fulcrums points to raise said seating member to said second position, and when further activated operates to pivot said first and second sets of parallel levers about said fulcrum points downward to said first position.

9. The tub of claim 8 wherein said piston is pneumatically activated.

10. The tub of claim 8 wherein said piston is hydraulically activated.

11. The tub of claim 8 wherein said cylinder is operatively mounted at a point beneath said operating rod, the piston of said cylinder having an axis of movement that extends generally upwardly when lifting said seating member to said second position.

12. The tub of claim 8 wherein said cylinder is operatively mounted to said frame at a point above said operating rod, the piston of said cylinder having an axis of movement that extends horizontally or generally downwardly as said seating member is lifted to said second position, whereby the space requirement beneath said tub enclosure may be minimized.

13. The tub of claim 1 wherein said lifting mechanism comprises:

(a) a hydraulic cylinder having a piston, said cylinder vertically oriented and attached to a substantially horizontal member beneath said seating member; and (b) said piston connected to the underside of said seating member, wherein when activated in one direction said piston extends upward to raise said seating member to said second position and when further activated in the other direction retracts to lower said seating member to said first position.

14. The tub of claim 1, further including a control for actuating said lifting mechanism.

15. A tub for use by handicapped or otherwise incapacitated persons for bathing or therapeutic purposes, comprising:

(a) a tub enclosure having a floor, said floor having an opening formed therethrough for receiving a seating member;

(b) a seating member having a front end and a rear end and opposed sides, said seating member so dimensioned to engage said tub enclosure around the opening in said floor portion and movable between a first position seated in the floor of the tub and an elevated position;

(c) the interface between the seating member and said opening being so sealed as to substantially prevent water leakage therethrough when said seating member is seated in the floor of the tub;

(d) an operating chamber formed beneath said seating member; and (d) a lifting mechanism positioned in said operating chamber, said lifting mechanism operatively attached to the underside of said seating member, said lifting mechanism, when activated in one direction raises said seating member to said second position at a height sufficient to enable handicapped persons to position themselves thereon, and when further activated in the other direction lowers said seating member to said first position in sealing engagement with the floor of said tub.

16. The tub of claim 15 wherein said front and rear ends and opposed sides of said seating member have beveled edges for mating with corresponding beveled edges around the interface of said tub enclosure, said seating member and/or the portion of the tub floor surrounding said opening further including an elastomeric seal around said interface between said beveled edges of said seating member and said beveled edges of said tub enclosure for sealing engagement thereof.

17. The tub of claim 15 wherein said seating member has a generally horizontal floor portion.

18. The tub of claim 15 wherein said seating member comprises:

(a) a generally horizontal floor portion; and (b) a back portion, said back portion integrally attached to said floor portion.

19. The tub of claim 15 wherein said tub enclosure further includes at least one drain aperture formed therethrough.

20. The bath of claim 15, wherein when said seating surface is matingly engaged with the floor of said tub enclosure, said bathtub resembles a conventional tub.

21. The tub of claim 15 wherein said lifting mechanism comprises:

(d) a frame positioned beneath said seating member;

(e) a lever system connecting said frame and said seating member; and (f) a piston/cylinder actuator operatively connected to said lever system to move said seating member between said first and second position responsive thereto.

22. The tub of claim 15 wherein said lifting mechanism comprises:

(g) a frame extending beneath said seating member;

(h) first and second pairs of levers, each of said levers including a long arm extending in generally parallel to said seat member and having a free end and a short arm extending downwardly and at an angle to said seat member and having a free end, the other ends of said long and short arms being pivotally connected to each other and pivotally attached to said frame at a fulcrum point wherein said levers are pivotally attached to said frame:

(i) the free ends of each of said long arms of said first pair of levers being pivotally connected to opposed sides of the rear end of said seating member and the free ends of each of said long arms of said second pair of levers being pivotally connected to opposed sides of said front end of said seating member;

(j) wherein the free ends of said short arms of one of said first and second pair of levers are connected by an operating rod;

(k) at least one connecting rod extending between and connecting said first and second pairs of levers;

(l) a cylinder having a piston, said piston operatively connected to said operating rod, wherein when activated said piston causes the long arms of said first and second set of parallel levers to simultaneously pivot upward about said fulcrums points to raise said seating member to said second position, and when further activated operates to pivot said first and second sets of parallel levers about said fulcrum points downward to said first position.

23. The tub of claim 22 wherein said piston is pneumatically activated.

24. The tub of claim 22 wherein said piston is hydraulically activated.

25. The tub of claim 22 wherein said cylinder is operatively mounted at a point beneath said operating rod, the piston of said cylinder having an axis of movement that extends generally upwardly when lifting said seating member to said second position.

26. The tub of claim 22 wherein said cylinder is operatively mounted to said frame at a point above said operating rod, the piston of said cylinder having an axis of movement that extends horizontally or generally downwardly as said seating member is lifted to said second position, whereby the space requirement beneath said tub enclosure may be minimized.

27. The tub of claim 15 wherein said lifting mechanism comprises:

(a) a hydraulic cylinder having a piston, said cylinder vertically oriented and attached to a substantially horizontal member beneath said seating member; and (b) said piston connected to the underside of said seating member, wherein when activated in one direction said piston extends upward to raise said seating member to said second position and when further activated in the other direction retracts to lower said seating member to said first position.

28. The tub of claim 15, further including a control for actuating said lifting mechanism.

* * * * *